US007237983B2

(12) United States Patent
Suilmann et al.

(10) Patent No.: US 7,237,983 B2
(45) Date of Patent: Jul. 3, 2007

(54) HYDRAULIC SHIELD SUPPORT

(75) Inventors: Franz-Heinrich Suilmann, Werne (DE); Friedrich Wilhelm Dannehl, Hagen (DE); Michael Dettmers, Kamen (DE); Werner Reinelt, Bochum (DE)

(73) Assignee: DBT GmbH, Lunen (DE)

( * ) Notice: Subject to any disclaimer, the term of this patent is extended or adjusted under 35 U.S.C. 154(b) by 11 days.

(21) Appl. No.: 10/874,081

(22) Filed: Jun. 22, 2004

(65) Prior Publication Data

US 2004/0258487 A1 Dec. 23, 2004

(30) Foreign Application Priority Data

Jun. 23, 2003 (DE) ..... 103 28 286

(51) Int. Cl.
*E21D 23/16* (2006.01)

(52) U.S. Cl. ..... 405/302; 91/170 MP

(58) Field of Classification Search ..... 299/33; 405/302, 288, 291; 91/170 MP, 171, 300, 91/297, 319, 390
See application file for complete search history.

(56) References Cited

U.S. PATENT DOCUMENTS

| | | | | |
|---|---|---|---|---|
| 3,672,174 A * | 6/1972 | Von Hippel | | 405/295 |
| 4,815,898 A | 3/1989 | Wojaczek et al. | | |
| 5,743,679 A | 4/1998 | Gottschlich | | |
| 6,056,481 A | 5/2000 | Waterman et al. | | |
| 6,295,914 B1 * | 10/2001 | Iversen | | 91/300 |
| 6,776,080 B2 * | 8/2004 | Hansen et al. | | 91/300 |

FOREIGN PATENT DOCUMENTS

| | | |
|---|---|---|
| DE | 3203084 | 8/1983 |
| DE | 3630579 | 3/1989 |
| DE | 19528378 | 4/1998 |
| DE | 19636389 | 5/2000 |
| DE | 10116916 | 10/2002 |
| GB | 1135942 | 12/1968 |
| GB | 2193745 | 2/1988 |
| GB | 2205346 | * 12/1988 |
| GB | 2316973 | * 3/1998 |

* cited by examiner

*Primary Examiner*—Sunil Singh
(74) *Attorney, Agent, or Firm*—Fay Sharpe LLP

(57) ABSTRACT

A hydraulic shield support is disclosed with at least two adjustable-length hydraulic props supporting a dedicated shield, which are connected through a control bank to a hydraulic fluid supply and borne on base shoes, and to which a pressure in excess of the pressure of the hydraulic fluid may be applied in the set condition of the shield support. In order to provide almost any pressure level at each shield support at a deep face in a simple way, the shield support has at least one pressure intensifier located in a hydraulic pipe system between the hydraulic fluid supply and the hydraulic props, with an oscillating intensifier piston in the form a differential piston effecting the increase in pressure. The low pressure inlet of the pressure intensifier is connected to the setting pressure pipes upstream, and its high-pressure outlet downstream, of a hydraulically-releasable non-return valve.

19 Claims, 5 Drawing Sheets

HYDRAULIC SHIELD SUPPORT

BACKGROUND

The present discovery relates to a hydraulic shield support such as may be used in underground mining. The shield support includes at least two adjustable-length hydraulic props borne on base shoes and supporting a shield, which may be connected through a control bank to a hydraulic fluid supply system. A pressure in excess of the pressure of the hydraulic fluid may be applied in the set condition of the shield support. The shield support may be a stope shield support, but the present discovery is not limited thereto.

In deep mining, hydraulic supports are used to keep the face or working area free and to support the so-called roof. In particular, they may take the form of lemniscate shields, as for example, disclosed in U.S. Pat. Nos. 4,815,898, 6,056,481 or 5,743,679, all of which are hereby incorporated by reference. The main or roof shield is supported by double acting, preferably multiple-stage hydraulic props, which are counter-borne on the base shoes. Setting or removing the shields takes place as a function of pilot signals from an electrical control unit, which automatically activates the actuators, such as e.g. electromagnets, allocated to the hydraulic actuation valves in the control banks. In the hydraulic shield supports currently used in deep mining, a setting pressure of approximately 320 bar may be applied to the hydraulic props and may subsequently be increased to a maximum pressure of approximately 400 bar to support the load of the rock. Both pressures are applied through the control bank.

Provision of the increased pressure through a second, supplementary supply system is known from DE 101 16 916 A1, hereby incorporated by reference. The provision of a principal supply system for a pressure of approximately 300 bar may keep the volume flows, which the supplementary supply system must be able to deliver for the pressure of approximately 400 bar, low, and mean that the supplementary supply system can be embodied with comparatively small cross-sections. This approach requires the laying of a second hydraulic supply system throughout the entire face, in addition to the principal supply system.

There is a constant demand for longer faces and higher-capacity winning and conveyor systems for the economic mining of coal or other minerals from deep faces. Consequently, the roof surface area to be supported by shield supports in the face area increases constantly. To support the rock, it is thus necessary to increase the resistance which can be applied to the shield by the hydraulic props. Fundamentally, the number of hydraulic props, their effective diameter or the pressure of the hydraulic fluid may be increased for this purpose.

BRIEF DESCRIPTION

The present discovery aims to create a hydraulic shield support with which greater support resistance may be achieved than with existing solutions, preferably without having to change the prop diameter and without additional outlay for piping for a supplementary supply system at a deep face.

The various exemplary embodiments described herein allocate at least one pressure intensifier to a hydraulic shield support, located in the hydraulic pipe system between the hydraulic supply and the hydraulic props. The pressure intensifier utilizes an oscillating intensifying piston, such as in the form of a differential piston which increases the pressure. An increase in pressure to almost any level can be achieved in each shield support by the pressure intensifier with an oscillating intensifier piston allocated to each shield support without having to lay an additional pipe designed for the high pressure throughout the entire face. The pressure intensifiers can supply an increased or intensified pressure which is proportional to the pressure in the supply system and thus to the pressure present at the low-pressure inlet of the pressure intensifier.

In one aspect according to the present discovery, a hydraulic shield support system is provided which is adapted for underground mining. The shield support system comprises one or more base shoes, a shield, and at least two adjustable length hydraulic props disposed on the base shoes. The props are adapted to support the shield. The shield support system further comprises a hydraulic fluid supply and a control bank in fluid communication with the hydraulic fluid supply and the hydraulic props. The system additionally comprises a hydraulic pipe system that provides fluid communication between the hydraulic fluid supply and the hydraulic props. The system further comprises at least one pressure intensifier in fluid communication with the hydraulic pipe system. The pressure intensifier includes an oscillating intensifier piston in the form of a differential piston for effecting an increase in pressure. The discovery includes various configurations of this system.

BRIEF DESCRIPTION OF THE DRAWINGS

Further advantages and embodiments of the present discovery emerge from the following description of the exemplary embodiments shown in diagrammatic form in the drawings. The drawings show the following.

DETAILED DESCRIPTION

Figure 1:
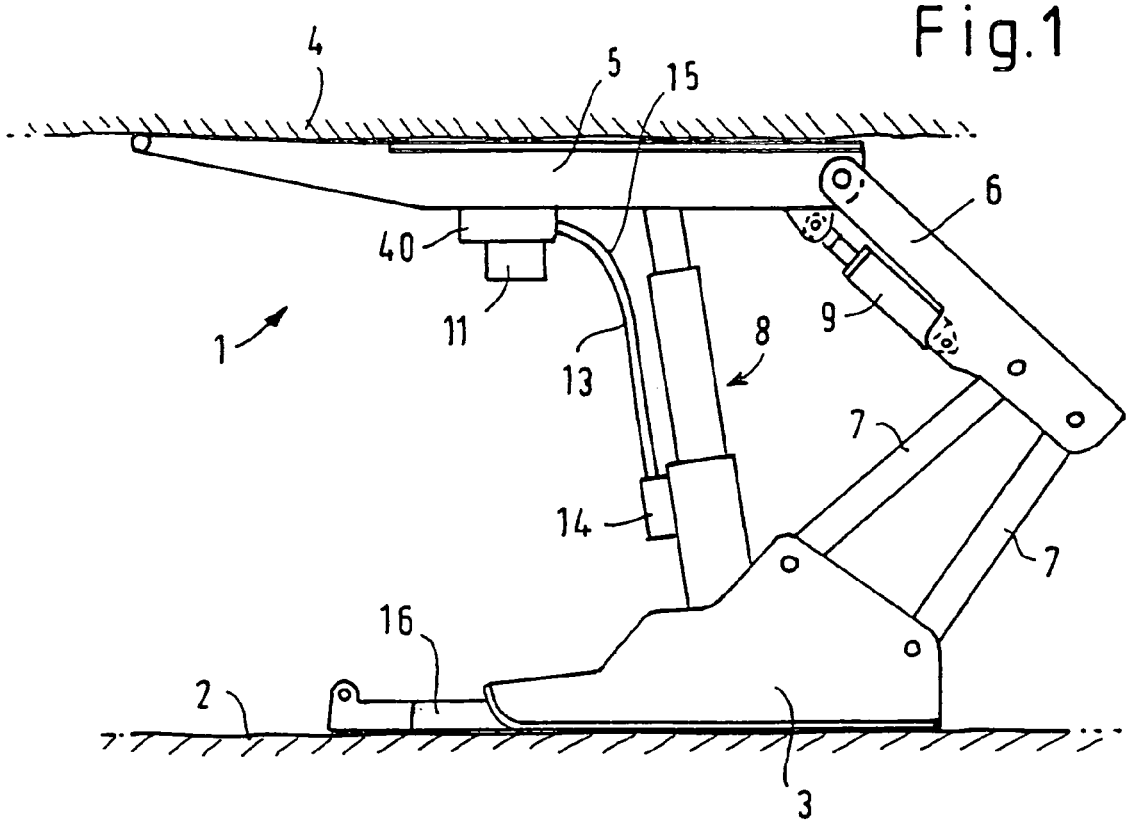
FIG. 1 is a schematic side elevation of an inventive shield support.

In one aspect of the discovery, pressure intensifiers are used which have a directional control valve for oscillating an intensifier piston. The piston includes a valve spool, and is preferably in the form of a differential piston. The hydraulic fluid from the supply system can be applied at one end of the piston, and preferably as a function of the control position of the valves in the control bank.

It is particularly advantageous if there is a pressure reducing valve and/or choke upstream of the pressure intensifier in each shield support, so that a constant level of high pressure may be achieved, irrespective of pressure fluctuations in the supply system and despite the unchangeable, proportional intensification of pressure. In an exemplary embodiment, the pressure intensifier on the hydraulic shield support is located in the pipe system between the control bank and the hydraulic props. As is known for a shield support, the control bank for each hydraulic prop may have a dedicated actuation valve connected to the allocated pressure chamber in the hydraulic prop by a separate branch pipe (setting pressure pipe) for supplying hydraulic fluid at setting pressure. In order to obtain a rapid accumulation of pressure in the hydraulic props to set the shield support, it is particularly favorable if both the actuation valves for the hydraulic props supporting the roof shield are actuated by a single, common pilot valve. In particular, the hydraulic props are designed as double acting and/or cylinders which telescope in multiple stages, to either end of which hydraulic fluid may be applied. It is also preferable for a common, particularly pilot-controlled actuation valve to be located in the control bank for removal of both the hydraulic props. A hydraulically releasable non-return valve, which can be released hydraulically by the pressure of the hydraulic fluid, may be located in the branch pipe of the setting pressure pipe for each hydraulic prop, for removing the hydraulic props.

In the exemplary embodiment of a shield support, a pressure intensifier dedicated to each hydraulic prop is located in the branch (setting pressure) pipe of the hydraulic prop. With a corresponding shield support, the outlay for additional pipes to be laid in the shield support is extremely low and the pressure intensifier may be located immediately at the inlet of the pressure chamber of the hydraulic prop, thus obviating the need for any hoses for hydraulic fluid at an increased level of high pressure. It is then particularly favorable to connect the low-pressure inlet of the pressure intensifier upstream of the non-return valve and the high-pressure outlet of the pressure intensifier downstream of the non-return valve to the appropriate branch pipes of the setting pressure pipes.

Alternatively, the entire shield support may have only one pressure intensifier, allocated to both hydraulic props. In one embodiment, the low-pressure inlet of the pressure intensifier on the branch (setting pressure) pipe of one of the two hydraulic props may be connected to the hydraulic prop upstream of the relevant non-return valve. Alternatively, the low-pressure inlet of the pressure intensifier may be connected directly, i.e. without an intermediate actuation valve, to the hydraulic fluid supply system at the low or outlet pressure, through a hydraulically releasable non-return valve. In order to nevertheless guarantee an application of pressure to the pressure chambers of both hydraulic props with hydraulic fluid at the intensified high-pressure level in both alternative embodiments, it is practical to connect the high-pressure outlet of the pressure intensifier to both branch (setting pressure) pipes, in both cases downstream of the releasable non-return valve provided for the relevant hydraulic prop. It is then recommended that a non-releasable non-return valve be located between the high-pressure outlet and the connecting points on both branch pipes.

In an embodiment in which the low-pressure inlet of the pressure intensifier is connected directly to the hydraulic supply system, the upstream releasable non-return valve can either be releasable by any setting pressure intensified by the pressure intensifier or an additional actuation valve may be located or provided in the control bank, by the operation of which the hydraulically-releasable non-return valve may be released. Hydraulic fluid at a pressure of 200 bar or 300 bar may be provided throughout the entire face. Alternatively, the supply system for each shield support or a group of shield supports may have a pump which brings the necessary pressure to the first level for initial setting of the hydraulic props and which is then increased to the high-pressure level by the pressure intensifier. Moreover, the high-pressure outlet of the pressure intensifier could also be connected to the pressure chamber of adjusting cylinders for a front cantilever.

FIG. 1 shows a simplified schematic or diagrammatic representation of a hydraulic shield support for use in deep winning operations, particularly coalface operations. The shield support 1 includes two base runners or shoes 3 located alongside each other resting on the face floor 2 and a roof shield 5 underpinning the so-called roof 4 and protruding further to the working or coal seam not shown. The shield support also includes a back shield 6 screening the face area from the goaf, and which is articulated to the floor shoes 3 by two arms 7, which together with two hydraulic props 8 supported on foot joints on the base shoes 3, it forms a lemniscate gear, in order to apply sufficient forces to the shield 5 to keep the face area free. The two hydraulic props 8 arranged as a pair alongside each other and each of which is supported on one of the two base shoes 3 are telescopic in several stages and may be subjected to pressure at either end, whereby a hydraulic fluid may be fed either to a pressure chamber in the hydraulic props 8 through separate pipes 13, 15, to press the shield 5 against the roof 4, thus setting the shield support 1 (the 'set condition'), or to an annulus, to collapse the hydraulic props 8 in the other direction for removal of the hydraulic shield support.

The shield support 1 is actuated from an electronic control unit 11 mounted on the shield 5, by means of which directional control valves in control bank 40 can be actuated to control operation of the shield support 1. The control bank can include a collection of selectively positionable control valves, each of which can be positioned to one or more control positions. A valve chest 14 is mounted on each hydraulic prop 8 and contains a non-return valve for the alternative application of pressure to the pressure chamber or annulus, to which hydraulic fluid for applying pressure in the pressure chamber to the hydraulic prop 8 may be fed through the pressure pipe (setting pressure pipe) 13 and to which hydraulic fluid may be fed to apply pressure to the annulus through another hydraulic pipe (removal pressure pipe) 15. The hydraulic fluid is supplied by a hydraulic fluid supply (not shown). As at least two hydraulic props 8 are provided, at least one other hydraulic pipe (setting pressure pipe) not shown leads to the hydraulic prop concealed in FIG. 1. The non-return valve in the valve chest 14 is arranged so that the hydraulic fluid can only drain from the pressure chamber of the hydraulic prop 8 if hydraulic fluid has been applied to the annulus of the hydraulic prop 8 through the removal pressure pipe 15.

At a deep mine face, the face area is supported by numerous hydraulic shield supports 1 located alongside each other and between each shield support 1 and the working face not shown in greater detail is a winning system, also not shown, such as e.g. a coal plough or drum cutter-loader with a chain dragline scraper. The winning system can be advanced towards the working face by the advancing ram 16. An angle cylinder 9 is interposed between the back shield 6 and the shield 5, to push or pull the principal or roof shield 5 against the roof or floor, either in parallel or at an angle to the roof or floor, as is generally known to a person skilled in the art. The supply of pressure to all the hydraulic shield supports 1 at the face, and thus the supply of hydraulic fluid to the control bank 40, takes place through a hydraulic supply system not shown here in greater detail, in which a pump may be provided for one or more shield supports 1, to provide the pressure chamber of the hydraulic props 8 with two different setting pressures during the setting process or in their set state, whereby working at an initial setting pressure (pressure of approximately 300 bar) and a second setting pressure (pressure of approximately 400 bar) is known in the state of the art.

At least one pressure intensifier is provided in the hydraulic pipe system for each shield support 1, which has an oscillating intensifier piston in the form of a differential piston which intensifies pressure. An inventive pressure enhancer is shown in diagrammatic form in FIG. 2 and will now initially be explained with reference thereto. The pressure enhancer may be inventively located on the shield support 1, the valve chest 14 for the non-return valve, the control bank 40, on setting pressure pipe 13 for hydraulic fluid or in parallel to control bank 40, as will be explained with reference to FIGS. 3 to 6.

Figure 2:
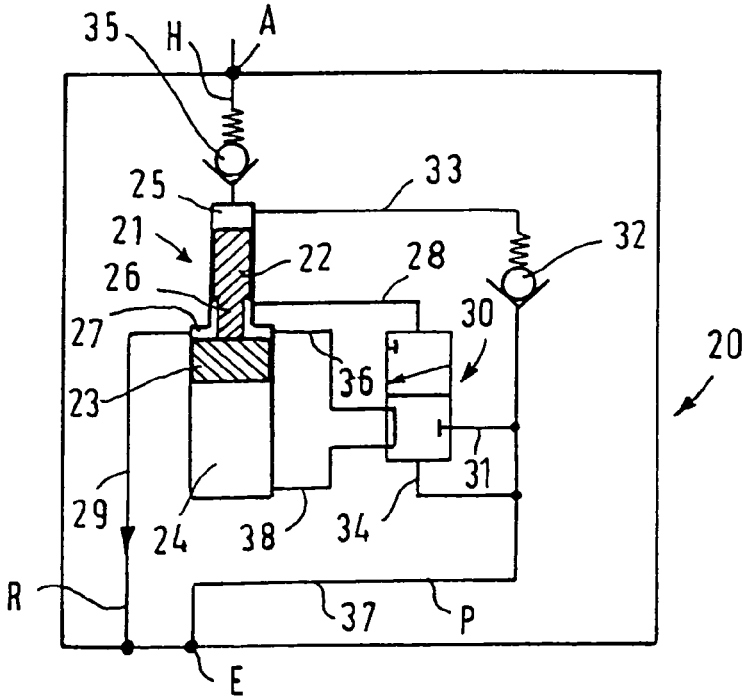
FIG. 2 is a simplified schematic representation of the structure of a suitable pressure intensifier.

The hydraulic high-pressure intensifier with the overall number 20 in FIG. 2 includes a low-pressure inlet E for hydraulic fluid with initial pressure P, a high pressure outlet A for fluid at the intensified high pressure H with a pressure sink R, which may be connected to a return pipe or the like, for example. The pressure intensifier 20 for hydraulic fluid includes an intensifier piston 21 in the form of a differential piston with a high-pressure piston 22 and a low pressure piston 23 of different diameters, which are located in a low-pressure piston chamber 24 and a high-pressure piston chamber 25 and connected to each other by the piston rod 26. The intensifier piston 21 may be activated by a directional control valve with the general designation 30, which preferably has a valve spool in the form of a differential piston, in such a way that the intensifier piston 21 oscillates automatically, so that hydraulic fluid is emitted from high-pressure outlet A at an increased pressure H corresponding to the transmission ratio of the high-pressure intensifier 20. Pressure intensification or transmission depends upon the ratio of the cross-section of the low-pressure piston 23 to the high-pressure piston 22. The directional control valve 30 takes the form of a 3/2 port directional control valve and hydraulic fluid at the initial pressure (pressure P) is present at the inlet connection 31 of directional control valve 30 as at inlet E. The movable valve spool of the direction control valve 30 is under a constant load from the initial pressure (pressure P) through pressure pipe 34 as at inlet E when the directional control valve 30 is closed. The supply to inlets 31, 34 takes place through feed pipe 37. Pressure P, which places a load upon one end of the valve spool piston (differential piston) of directional control valve 30 at inlet 34, is thus constant when the pressure intensifier 20 is in operation. FIG. 2 shows the pressure intensifier 20 at the end of the working stroke of intensifier piston 21 when directional control valve 30 is not under load or closed. In the position of the intensifier piston 21 shown, pressure is present at the level of the pressure sink R, due to the control position of directional control valve 30 in low-pressure chamber 24 and in the annulus 27 through pipes 38, 36 and 29. As the hydraulic fluid in the high-pressure chamber 25 is at pressure H as at high-pressure outlet A, the intensifier piston 21 is moved downwards. At the end of its downward movement, the high-pressure piston 22 opens pilot pipe 28, whereby pressure of at least pressure level P is present, due to the supply 33 protected by the non-return valve 32. This moves the valve spool of direction control valve 30, which also takes the form of a differential piston, into a control position in which hydraulic fluid at pressure P is fed through hydraulic inlet 31 into the low-pressure chamber 24 of the intensifier piston 21, entailing renewed upward movement of the intensifier piston 21 until both the intensifier piston 21 and the directional control valve 30 have returned to the initial position shown in FIG. 2, at which another working stroke commences. Operation of the differential piston in directional control valve 30 is by means of the initial pressure P, supplied through inlet pipe 34. In the control position not shown, the directional control valve 30 opens a connection for fluid between the low-pressure inlet E and the low-pressure chamber 24 of the intensifier piston 21 through hydraulic inlet 31 and connecting pipe 38. The preferred design and method of operation of the pressure intensifier is disclosed in DE 196 33 258 C2 (English language equivalent U.S. Pat. No. 6,295,914), to the content of which express reference is made to complement this disclosure, and which is hereby incorporated by reference. A volume flow at the intensified pressure H is obtained at the outlet of the pressure intensifier 20 on each working stroke of the intensifier piston 21, doubling, for example, inlet pressure P. A backward flow of hydraulic fluid at high pressure H through the pressure intensifier 20 is prevented by the outlet non-return valve 35. The integration or installation of a pressure intensifier 20 in accordance with FIG. 2 into the hydraulic system of the inventive shield support (1, FIG. 1) will now be explained using various exemplary embodiments, with reference to FIGS. 3 to 6.

Figure 3:
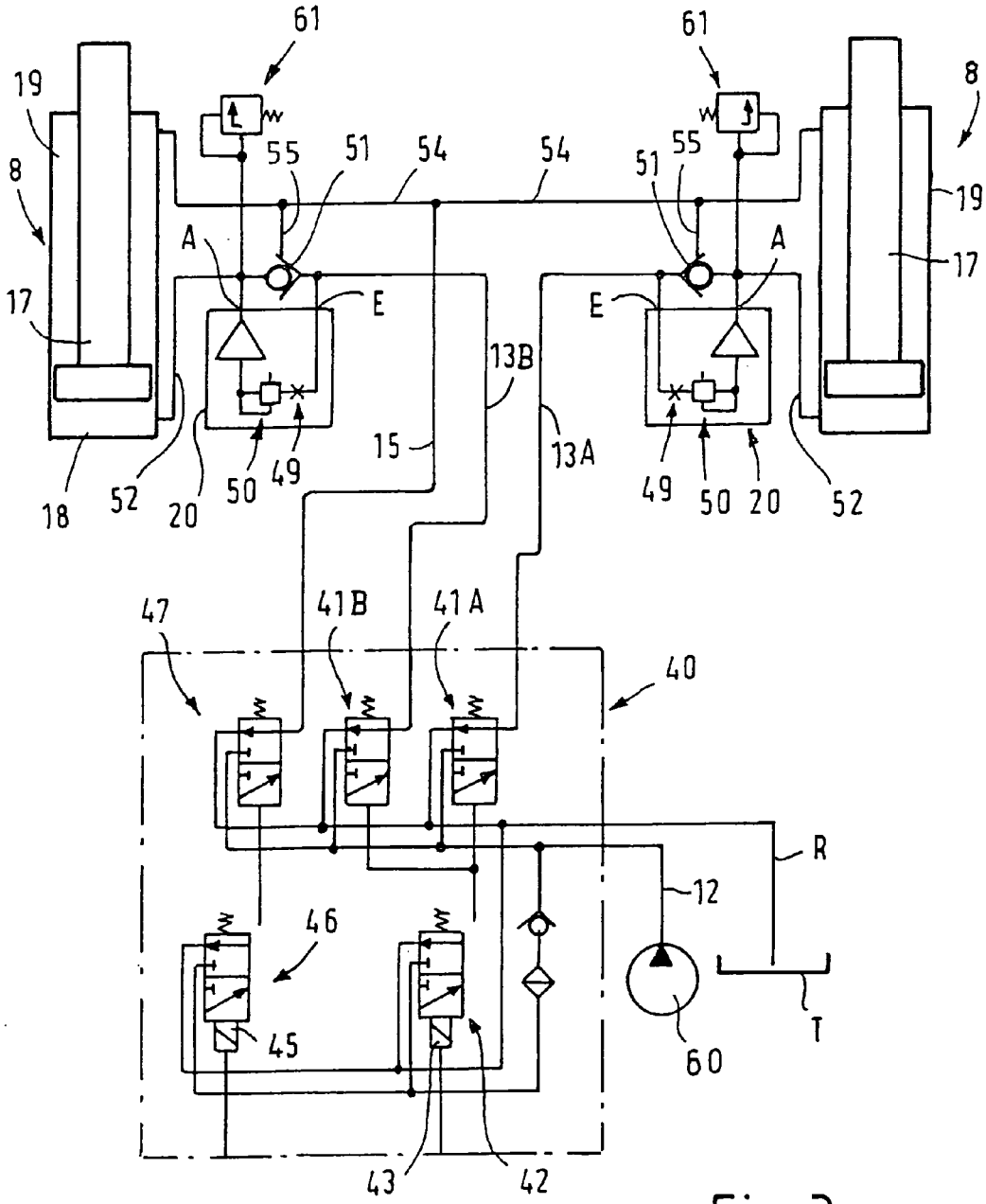
FIG. 3 is a schematic representation of the integration of a pressure intensifier into the hydraulic circuit of a shield support in accordance with the first exemplary embodiment, as a hydraulic circuit diagram.

In the exemplary embodiment in accordance with FIG. 3, the shield support has a dedicated, separate pressure intensifier 20 for both hydraulic props 8, shown here with one, only simply extendable, doubly-loadable piston 17. Both the pressure intensifiers 20 are connected to relevant setting pressure pipes 13A, 13B, to each of which a separate spring-return, pilot-controlled main control valve 41A, 41B is allocated in control bank 40, shown diagrammatically only as a 3/2 port directional control valve, which, depending upon the control position, connects the setting pressure pipes 13A, 13B to the return tank T or a hydraulic fluid supply 12, in which hydraulic fluid at pressure P or a pump pressure level applied by the pump 60 is present. To simplify further illustration, it is assumed that pressure P is present in the supply 12 and pressure R is present in the tank return pipe. Both the main control valves 41A, 41B are actuated by a common pilot control valve 42 with a suitable actuator 43 such as, for example, a solenoid valve operated by a pilot signal from the control unit (11, FIG. 1). The control bank 40 also includes a pilot or main control valve 47 which can be actuated by the actuator 45 and the pilot control main 47, in order to load the removal pressure pipe 15 with hydraulic fluid at removal pressure, which is pressure P. Each of the setting pressure pipes 13A, 13B leads through a non-return valve 51 located in the relevant branch pipe directly to the pressure chamber 18 of the hydraulic props 8. The low-pressure inlet E of a pressure intensifier 20 is also connected to both setting pressure pipes 13A, 13B upstream of the non-return valve 51, whereby the pressure intensifier 20 is constructed as described above. However, a choke 49 and then a pressure reduction valve 50 are first hydraulically interposed between the low-pressure inlet E and the actual oscillating intensifier unit of each pressure intensifier 20 to obtain the same pressure H at high-pressure outlet A, even at different setting pressures in setting pressure pipes 13A, 13B by means of the proportionally-intensifying pressure intensifier 20. The pressure intensifier 20 does not intensify the pressure until the pilot control valve 42 has operated the main control vales 41A, 41B and setting pressure is present in the setting pressure pipes 13A, 13B. At the outset, the pressure from the setting pressure pipes 13A, 13B is applied to pressure chamber 18 through the feed pipe 52. Only low volume flows need therefore be guaranteed by the pressure intensifier 20 in order to be able to apply the higher, intensified pressure to the hydraulic props 8 in the set state. The high-pressure outlet A of the pressure intensifier 20 is connected to the feed pipes 52 downstream of the non-return valves 51. In the set state of both hydraulic props 8, a backward flow of the hydraulic fluid at high pressure H through the non-return valves 51 is prevented. Both hydraulically releasable non-return valves are released when the pilot-controlled control valve 47 is operated by a pilot signal from the control unit (11, FIG. 1) and removal pressure is present in the removal pressure pipe 15. The removal pressure pipe 15 leads to both the annuli 19 of the hydraulic props 8 through the branch pipes 54 to retract or remove the hydraulic props 8 and thus the shield support (1, FIG. 1). Simultaneously, the non-return valve 51 is released due to the simultaneous presence of hydraulic fluid at removal pressure at both non-return valves 51 through the actuation pipe 55, permitting the fluid under high pressure to flow back into the tank T from the pressure chamber 18 and through the non-return valve 51, the pipes 13A, 13B and the main control valves 41A, 41B. A further pressure control valve 61, pressure sensors, manometers, etc. may be located in both feed pipes 52 downstream of the respective non-return valve 51.

Figure 4:
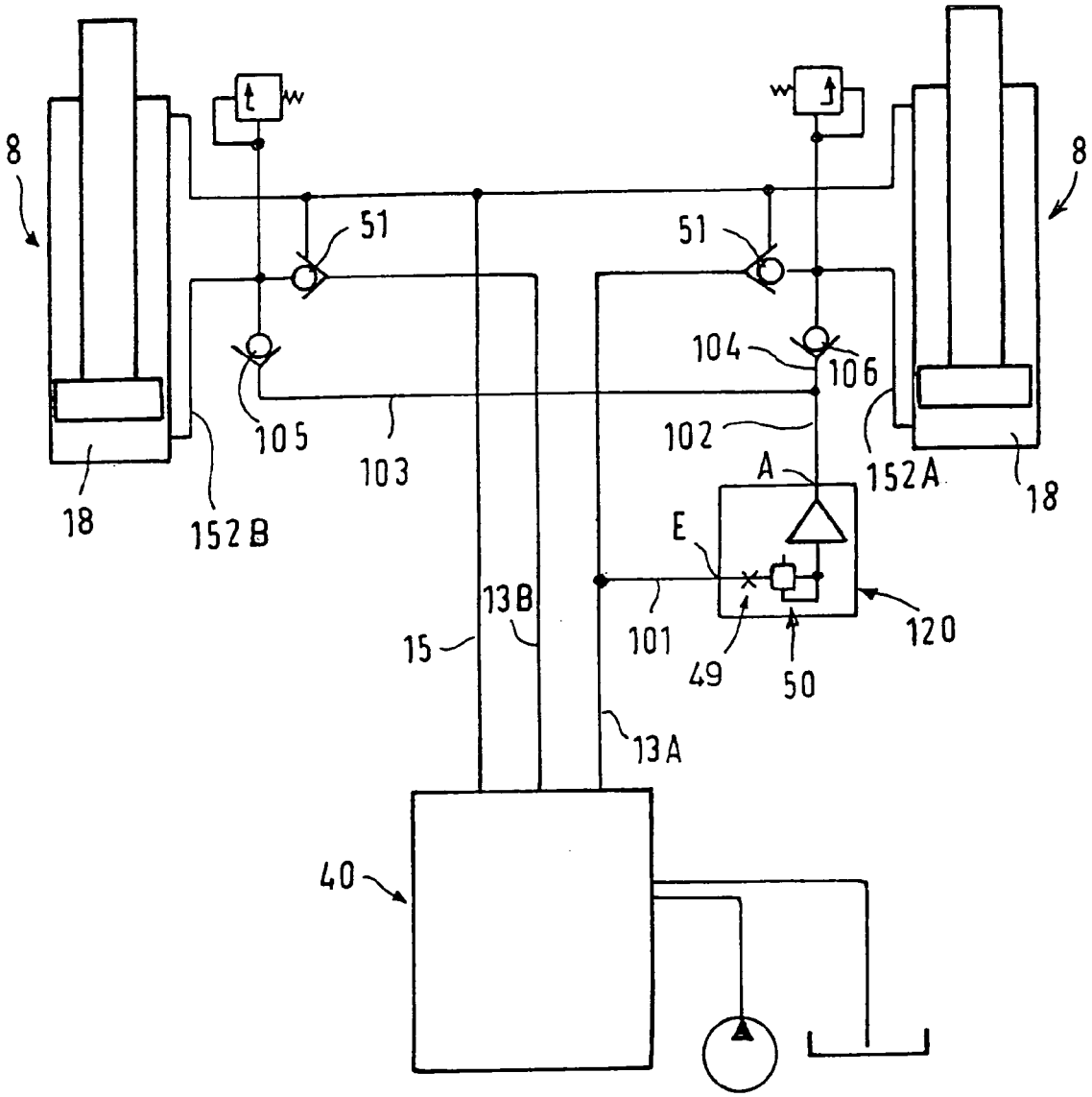
FIG. 4 is a schematic representation of the integration of the pressure intensifier in accordance with a second exemplary embodiment, as a hydraulic circuit diagram.

FIG. 4 shows a second exemplary embodiment, in which only one single pressure intensifier 120 with an upstream or integrated pressure control valve 50 and choke 49 are provided for both hydraulic props. The same components as in the previous embodiment are provided, with the same reference numerals, and both the hydraulic props 8 and the control bank 40 are identical in structure to the previous embodiment, so no new description is provided at this point. The low-pressure inlet E of the common pressure enhancer 20 provided for hydraulic props 8 is connected to only one of the two branch pipes (setting pressure pipes 13A, 13B) for hydraulic props 8, in this case the setting pressure pipe 13A, by a connecting pipe 101. The high-pressure outlet A of pressure intensifier 120, is connected to the feed pipes 152B, 152A by the connecting pipe 102, the two branch pipes 103, 104 and two hydraulically non-releasable non-return valves 105, 106 downstream of the hydraulically-releasable non-return valves 51.

Hydraulic fluid at the intensified pressure H can thus be supplied to the feed pipes 152A, 152B to pressure chamber 18 of the hydraulic props 8 through the central pressure intensifier 120 for both hydraulic props 8.

Figure 5:
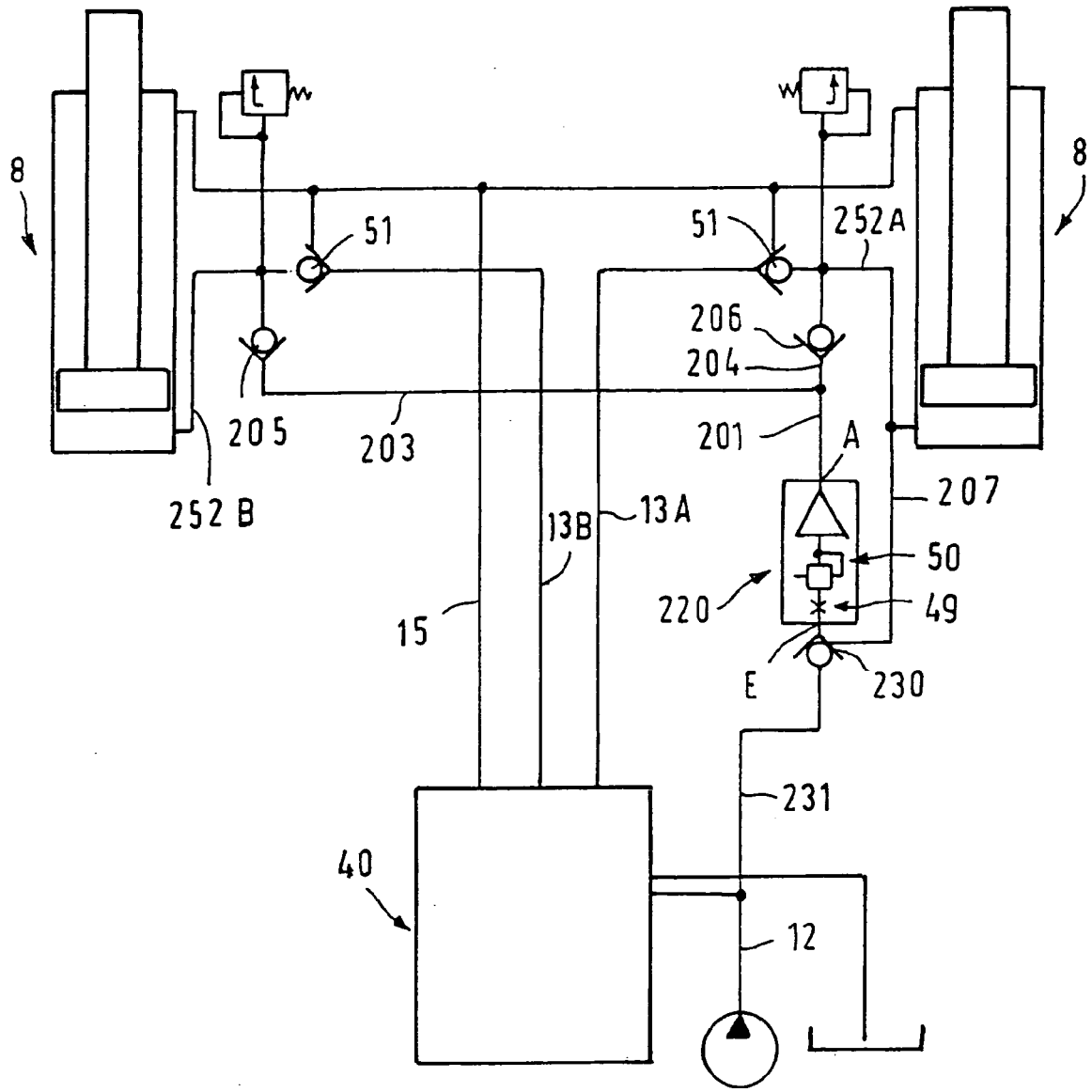
FIG. 5 is a schematic representation of the integration of a pressure intensifier in accordance with a third exemplary embodiment, as a hydraulic circuit diagram.

In the embodiment in accordance with FIG. 5 a central pressure intensifier 220 is provided for both hydraulic props. The control bank 40 for loading both hydraulic props 8 through setting pipes 13A, 13B or removal pressure pipe 15 is identical in structure to the embodiment in FIG. 3, so no new description is provided here. The low-pressure inlet E of pressure intensifier 220 is connected directly to the hydraulic fluid supply 12 at pressure P through connecting pipe 231, through an intermediate hydraulically releasable non-return valve 230. As in the previous embodiment, the high-pressure outlet A is connected to the pressure chamber of hydraulic props 8 by connecting pipe 201, two branch pipes 203, 204 and two non-releasable non-return valves 205, 206 downstream of the releasable non-return valves 51 on feed pipes 252A, 252B. The feed pipe 252A from the branch pipe of the setting pressure pipe 13A is connected to releasable non-return valve 230 at the inlet side of pressure intensifier 220 by a further branch pipe 207, whereby hydraulic fluid at high pressure H is present here in the set state. The inlet non-return valve 230 does not open until setting pressure is present in the branch pipe of setting pressure pipe 13A.

Figure 6:
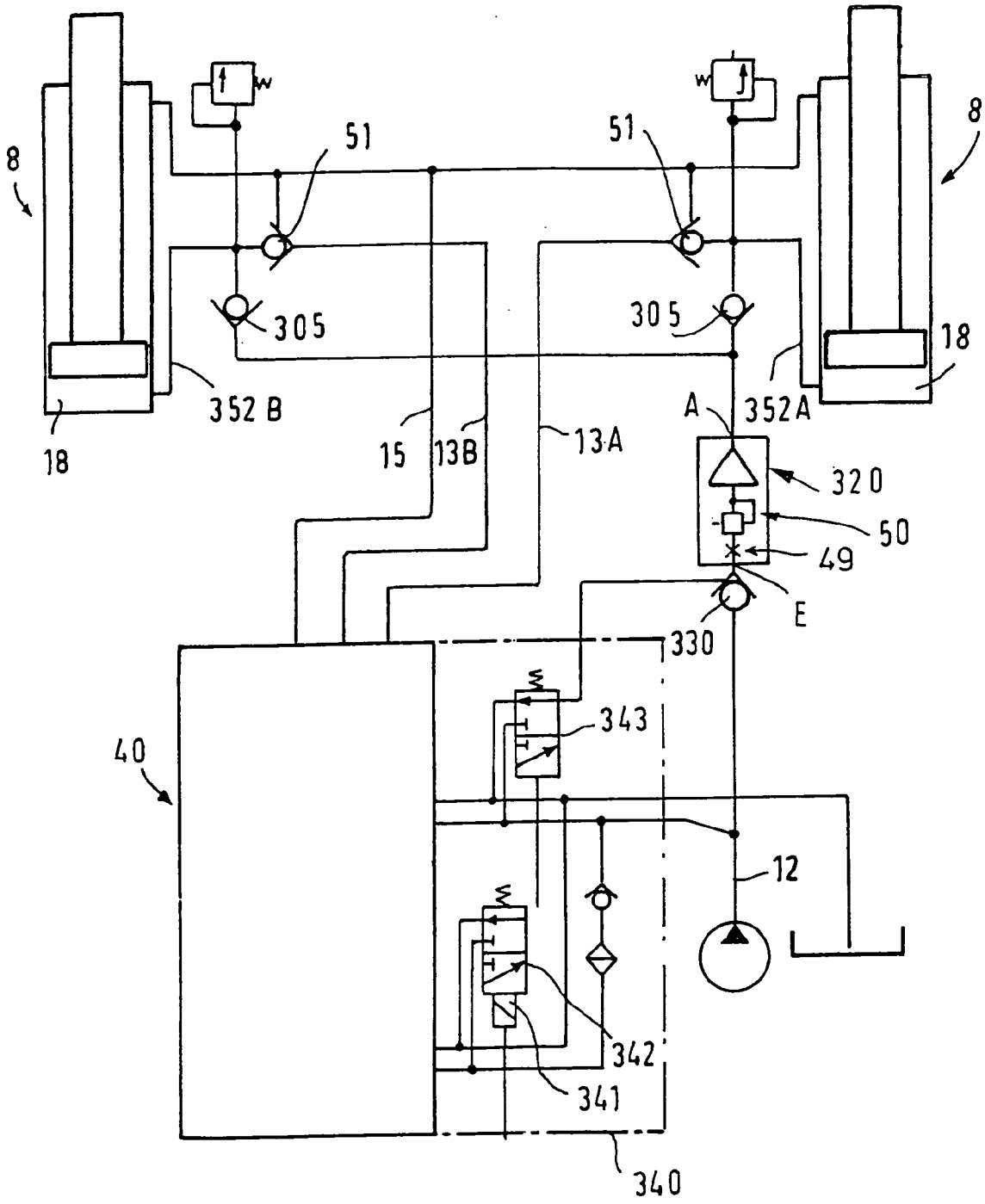
FIG. 6 is a schematic representation of the integration of a pressure intensifier in accordance with a fourth exemplary embodiment, as a hydraulic circuit diagram.

In the exemplary embodiment in FIG. 6, control bank 40 has a bank section 340 in which an additional actuation valve 343 is located to actuate a central pressure intensifier 320 for both hydraulic props 8, to which a choke 49 and a pressure reduction valve 50 are allocated downstream of the low-pressure inlet E. An electrically-actuated pilot control valve 342 and the downstream main control valve 343 are located in bank section 340, dependent upon the signal from the electronic control unit (11, FIG. 1) through the actuator 341, in order to release a hydraulically-releasable non-return valve 330, located between the low-pressure inlet E and the main 12. This actuates the hydraulic pressure intensifier 320. Outlet A of the pressure intensifier 320 is connected by feed pipes 352A, 352B to the pressure chamber 18 of the hydraulic props 8 by connecting pipes, branch pipes and non-releasable non-return valves 305 downstream of non-return valves 51, as in the specimen embodiments in accordance with FIG. 4 and FIG. 5. Resetting the actuation valve 343 deactivates pressure intensifier 320.

Modifications and variations on the above described embodiments will be apparent to a person skilled in the art and still within the scope of the present discovery which is defined by the appended claims. Both the branch pipes and the setting pressure pipes also could be actuated separately by means of separate pilot control valves. The fluid under high pressure available at the high-pressure outlet of the pressure intensifier could also be used to operate other cylinders, such as adjusting cylinders for front cantilevers or similar. The present discovery includes combining features and aspects of the various exemplary embodiments described herein.

The foregoing description is, at present, considered to be the preferred embodiments of the present discovery. However, it is contemplated that various changes and modifications apparent to those skilled in the art, may be made without departing from the present discovery. Therefore, the foregoing description is intended to cover all such changes and modifications encompassed within the spirit and scope of the present discovery, including all equivalent aspects.

The invention claimed is:

1. A hydraulic shield support system adapted for underground mining, the shield support system comprising:

at least one base shoe;

a shield;

at least two adjustable length hydraulic props disposed on the base shoes, the props adapted to support the shield;

a hydraulic fluid supply;

a control bank in fluid communication with the hydraulic fluid supply and the hydraulic props, the control bank including at least one control valve;

a hydraulic pipe system providing fluid communication between the hydraulic fluid supply and the hydraulic props;

at least one pressure intensifier in fluid communication with the hydraulic pipe system, the pressure intensifier including an oscillating intensifier piston in the form of a differential piston for effecting an increase in pressure and a pilot pipe providing fluid communication between a directional control valve and the intensifier piston, whereby at the end of downward movement of the intensifier piston, hydraulic fluid in the pilot pipe, moves the directional control valve into a position that imparts upward movement of the intensifier piston.

2. The hydraulic shield support system of claim 1 wherein the hydraulic props are adapted to receive a pressure in excess of the pressure of the hydraulic fluid in a set condition of the shield support system.

3. The hydraulic shield support system in accordance with claim 1, wherein (i) the control bank includes a plurality of valves positionable to one or more control positions, and (ii) the directional control valve has a valve spool in the form of a second differential piston, whereby hydraulic fluid from the hydraulic fluid supply may be applied to one end of the second differential piston of the directional control valve, depending upon the control position of valves in the control bank.

4. The hydraulic shield support system in accordance with claim 1, further comprising at least one of a pressure reduction valve and a choke disposed hydraulically upstream of each pressure intensifier.

5. The hydraulic shield support system in accordance with claim 1, wherein the pressure intensifier includes a low pressure inlet which is connected between the control bank and the hydraulic props.

6. The hydraulic shield support system in accordance with claim 1, wherein each hydraulic prop includes a pressure chamber and the control bank includes a control valve for each hydraulic prop, the system further comprising:

a branch pipe providing fluid communication between a control valve and a corresponding pressure chamber; and a pilot control valve configured to actuate the control valves of the control bank.

7. The hydraulic shield support system in accordance with claim 6, wherein each hydraulic prop has a dedicated pressure intensifier located in a corresponding branch pipe.

8. The hydraulic shield support system in accordance with claim 1, wherein each of the hydraulic props include an annuli which upon receiving hydraulic fluid, retracts a corresponding hydraulic prop, and the control bank includes a main control valve configured to direct hydraulic fluid to the annuli and effect retraction of the hydraulic props.

9. The hydraulic shield support system in accordance with claim 8, wherein each hydraulic prop includes a hydraulically releasable non-return valve which is releasable by the pressure of the hydraulic fluid for retracting the hydraulic props.

10. The hydraulic shield support system in accordance with claim 1 wherein the control bank includes a control valve for each hydraulic prop, the system further comprising:

a branch pipe providing fluid communication between a control valve and at least one hydraulic prop; and a hydraulically releasable non-return valve which is releasable by the pressure of the hydraulic fluid and in fluid communication with the branch pipe, wherein each pressure intensifier includes a low-pressure inlet and a high-pressure outlet, the low-pressure inlet being disposed upstream of the non-return valve, and the high-pressure outlet being disposed downstream of the non-return valve.

11. The hydraulic shield support system of claim 1 wherein at least one of the pressure intensifiers includes a low-pressure inlet, the system further comprising:

a hydraulically releasable non-return valve, the non-return valve controlling fluid communication between the low-pressure inlet and the hydraulic fluid supply.

12. The hydraulic shield support system in accordance with claim 1, wherein only one pressure intensifier is allocated to the at least two hydraulic props.

13. The hydraulic shield support system of claim 12 wherein the control bank includes a control valve for each hydraulic prop, the system further comprising:

a branch pipe providing fluid communication between a control valve and a corresponding pressure chamber; and a hydraulically releasable non-return valve, wherein the pressure intensifier includes a low-pressure inlet in fluid communication with one of the at least two hydraulic props and disposed upstream of the non-return valve.

14. The hydraulic shield support system in accordance with claim 12 wherein the control bank includes a control valve for each hydraulic prop, the system further comprising:

a branch pipe providing fluid communication between a control valve and a corresponding hydraulic prop; and a hydraulically releasable non-return valve which is releasable by the pressure of the hydraulic fluid, wherein the one pressure intensifier includes a high-pressure outlet in fluid communication with the branch pipe and downstream of the non-return valve.

15. The hydraulic shield support system of claim 14 wherein the system further comprises:

a non-releasable non-return valve disposed between the high pressure outlet of the one pressure intensifier and the branch pipe.

16. The hydraulic shield support system of claim 15 wherein the one pressure intensifier includes a low-pressure inlet and the hydraulically releasable non-return valve is in fluid communication with the low-pressure inlet of the pressure intensifier and the hydraulically releasable non-return valve is releasable depending upon the setting pressure.

17. The hydraulic shield support system of claim 14 wherein the control bank includes an actuation valve and the one pressure intensifier includes a low-pressure inlet and the hydraulically releasable non-return valve is in fluid communication with the low-pressure inlet of the pressure intensifier and the hydraulically releasable non-return valve is releasable by the actuation valve.

18. The hydraulic shield support system in accordance with claim 1, wherein the system further comprises a pump for pumping hydraulic fluid.

19. The hydraulic shield support system of claim 1 wherein the pressure intensifier includes a high-pressure outlet, the system further comprises:

a front cantilever having at least one adjusting cylinder that includes a pressure chamber, wherein the pressure chamber is in fluid communication with the high-pressure outlet of the pressure intensifier.

* * * * *